United States Patent [19]

Kasuga et al.

[11] 4,348,969

[45] Sep. 14, 1982

[54] SEWING MACHINE WITH A HORIZONTAL-TYPE LOOP TAKER

[75] Inventors: Noboru Kasuga, Hachioji; Kazumasa Hara, Tama; Mikio Koike, Oume, all of Japan

[73] Assignee: Janome Sewing Machine Co. Ltd., Tokyo, Japan

[21] Appl. No.: 129,206

[22] Filed: Mar. 11, 1980

[30] Foreign Application Priority Data

Mar. 26, 1979 [JP] Japan ..... 54-38906[U]

[51] Int. Cl.[3] ..... D05B 57/14; D05B 3/02

[52] U.S. Cl. ..... 112/184; 112/158 R

[58] Field of Search ..... 112/184, 157, 158 R, 112/181, 228, 202, 302

[56] References Cited

U.S. PATENT DOCUMENTS 4,266,494 5/1981 Ketterer ..... 112/184

*Primary Examiner*—Peter P. Nerbun

*Attorney, Agent, or Firm*—Michael J. Striker

[57] ABSTRACT

A thread loop regulating arrangement is provided in a sewing machine having a reciprocated swingable needle carrying an upper thread and a loop taking arrangement including a rotatable loop taker, a bobbin carrier having a predetermined surface to receive thread loops and a bobbin positioned within the bobbin carrier. The thread loop regulating arrangement includes a relatively flat plate placed against the predetermined surface of the bobbin carrier and spaced therefrom and a downwardly extended lip for guiding the thread loop pulled off the bobbin carrier and thereby preventing the formation of undesirable stitches.

1 Claim, 17 Drawing Figures

SEWING MACHINE WITH A HORIZONTAL-TYPE LOOP TAKER

BACKGROUND OF THE INVENTION

Field of the Invention

The invention relates to a sewing machine, and more particularly relates to a horizontal-type loop taker for a zigzag sewing machine.

The sewing machine of the foregoing type normally includes a main shaft which is rotatable to vertically reciprocate a needle carrying an upper thread. The needle is swingable in a direction transverse to that of the feeding fabric direction. A throat plate is secured to a machine bed and a loop taking arrangement is provided in the sewing machine. The loop taking arrangement includes a rotatable loop taker having a hook to draw the thread loops formed under the throat plate, a bobbin carrier supported in the loop taker and a bobbin disposed in a depression formed in the bobbin carrier.

In the known sewing machines poor or undesirable seams may be formed during the formation of the stitches in the loop taking arrangement.

SUMMARY OF THE INVENTION

It is an object of the invention to prevent the formation of undesirable seams in operation of the sewing machines having loop takers of a horizontal type.

This and other objects of the invention are attained by a provision of a thread loop regulating means mounted on the underside of the throat plate of the sewing machine which is positioned against a predetermined surface provided on a bobbin carrier for receiving thread loops. The thread loop regulating means prevents twisting of the upper thread during the formation of the stitches. The thread loop regulating means may be formed as a relatively flat plate with a downwardly extending lip overhanging the predetermined surface of the bobbin carrier.

DETAILED DESCRIPTION OF THE INVENTION

Figure 1:
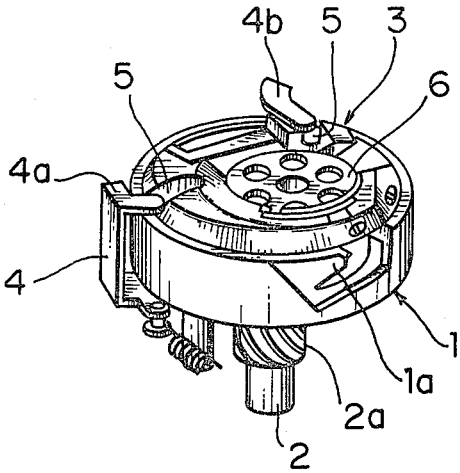
FIG. 1 PRIOR ART
FIG. 1 is a perspective view of a conventional loop taker of horizontal type.
Figure 2:
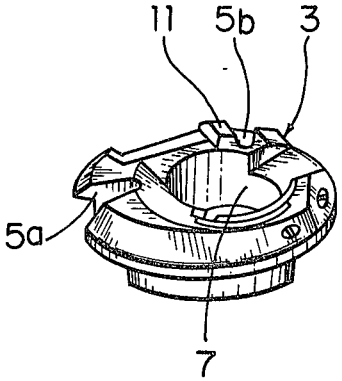
FIG. 2 PRIOR ART
FIG. 2 is a perspective view of a conventional bobbin carrier used in combination with the loop taker in FIG. 1.
Figure 7:
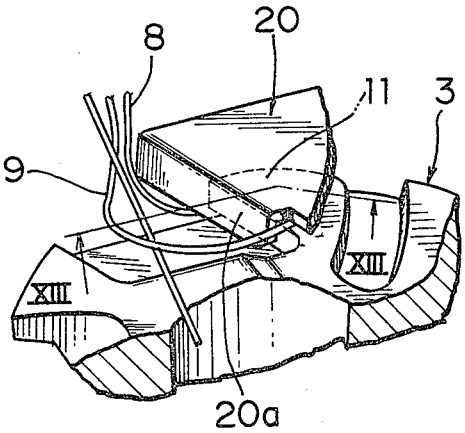
FIG. 7 is a perspective view partly in section of a loop taker of the invention.
Figure 8:
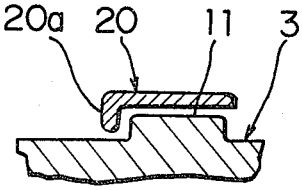
FIG. 8 is a partial front elevational view at the loop taker of the invention in a vertical section taken along the line XIII—XIII of FIG. 7.

FIG. 1 and FIG. 2 show one example of the prior art, namely a conventional loop taker device of horizontal type of a sewing machine, in which the reference numeral 1 denotes a cup shaped rotary loop taker provided with a loop taking hook 1*a*. The loop taker 1 has a central vertical shaft 2 with a gear 2*a* which is operatively connected to a main shaft (not shown) of a sewing machine, so that the loop taker may be rotated twice per rotation of the main shaft. A bobbin carrier 3 is supported in the loop taker 1. The bobbin carrier 3 is formed with a central depression 7 in which a lower thread supplying bobbin 6 is placed. As shown, the bobbin carrier 3 is formed with a pair of spaced recesses 5*a*, 5*b*. A detaining element 4 with two spaced arms 4*a*, 4*b* is swingable in synchronism with rotation of the loop taker 1. The two arms 4*a*, 4*b*, therefore, alternately engage the recesses 5*a*, 5*b* of the bobbin carrier 3 respectively, thereby to prevent the bobbin carrier 3 from being rotated with the loop taker 1 and at the same time to allow a thread loop taker by the hook 1*a* of loop taker 1 to pass through the clearances one after another, which are formed between the arms 4*a*, 4*b* and the recesses 5*a*, 5*b* respectively, so as to be pulled up to form a seam due to the action of a thread take-up lever (not shown) of a sewing machine.

Figure 3:
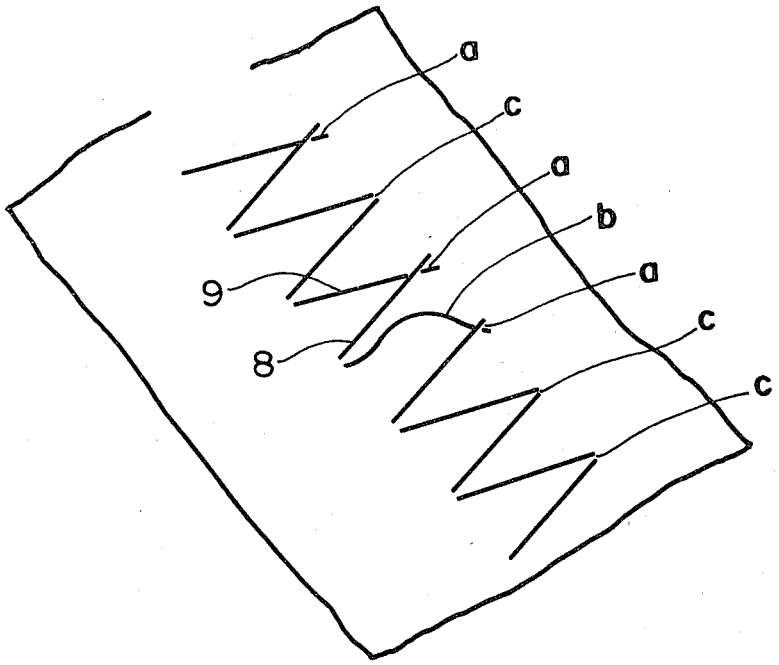
FIG. 3 is a plan view of the zigzag seams produced by a sewing machine employing the horizontal-type loop taker as shown in FIGS. 1 and 2.
Figure 4:
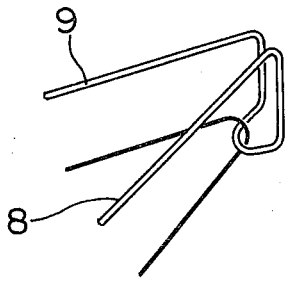
FIG. 4 is a perspective view of a structure of a normal zigzag seam.
Figure 5:
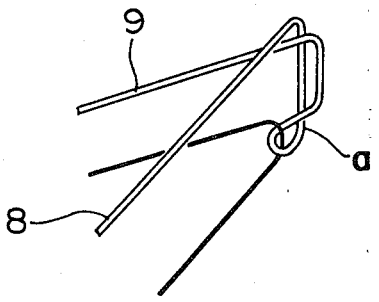
FIG. 5 is a perspective view of a structure of a poor and undesirable zigzag seam.

FIG. 3 shows the zigzag seams formed up by a sewing machine using the conventional loop taker device of horizontal type as shown in FIG. 1 and FIG. 2. The sewing machine of the conventional loop taker often produces poor seams as shown by the letters (a) and (b). FIG. 4 shows a formation of normal seam (C), (see FIG. 3) in which the precededly formed seam 9 is not crossed on the right side end thereof by the next seam 8 which is an extension of the upper sewing thread and is led to the thread take-up lever (not shown) of the sewing machine. On the other hand, FIG. 5 shows a formation of the poor seams, in which the precededly formed seam 9 is crossed on the right side end (a) thereof by the next seam 8. Such a crossing seam is often accompanied by a slackened preceding seam (a), to detract the appearance of seams.

Figure 6A:
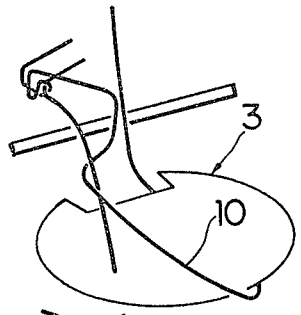
FIGS. 6A–6E show a formation process of the zigzag seam of FIG. 5 provided by the loop taker shown in FIGS. 1 and 2.
Figure 6B:
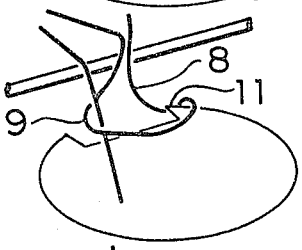
Figure 6C:
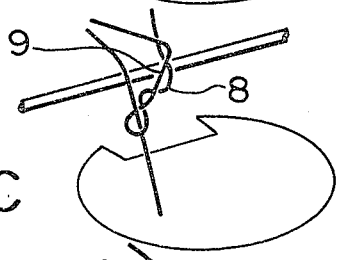
Figure 6D:
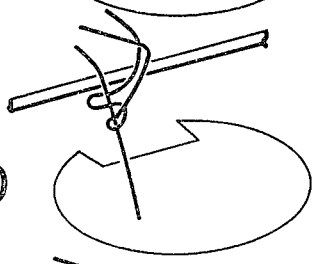
Figure 6E:
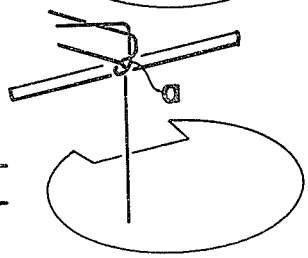
Figure 9A:
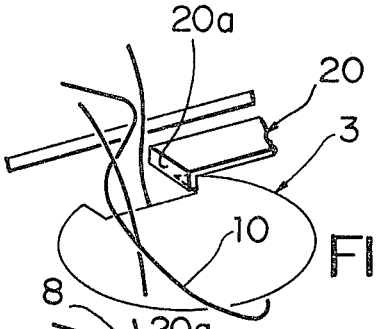
FIGS. 9A–9E illustrate a formation process of the zigzag seam of FIG. 4 provided by the loop taker of the invention shown in FIG. 7.
Figure 9B:
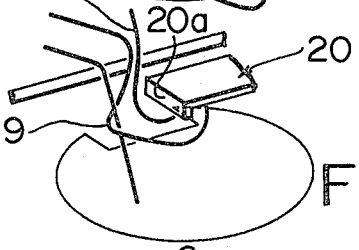
Figure 9C:
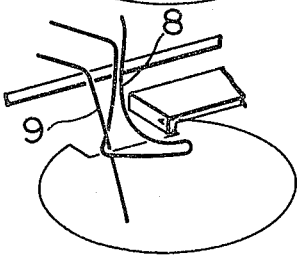
Figure 9D:
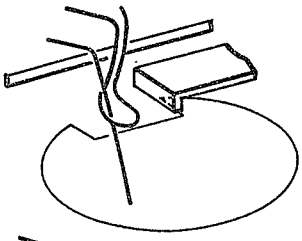
Figure 9E:
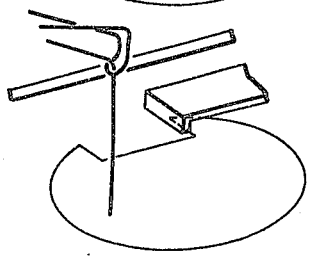

FIGS. 6A–6E illustrate a process of formation of such poor or crossed seams, in which the stages shown in FIGS. 6A and 6B show that an upper thread loop 10 taken by the loop taker 1 is guided around the bobbin carrier 3 and is going to be pulled up from the bobbin carrier 3 at a part 11 thereof by the thread take-up lever. The stages shown in FIGS. 6C–6E show that the upper thread 8 on the underside of the sewn fabric is thrown off to the other side of the precededly formed seam 9 by a momentary force of inertia produced at the final point where the upper thread is pulled off the bobbin carrier 3, and is tightened to form the next crossing seam. In the meantime, the "two" threads 9, 8 are tightly twisted to disturb the complete thread tightening effect of the thread take-up lever. As a result, the preceding seam 9 is slackened. Such poor or crossed seams are scarcely produced in the stitching operation of a sewing machine driven at a lower speed of less than 500 r.p.m. Such poor or crossed seams become conspicuous when the sewing machine is driven at a higher speed of more than 500 r.p.m.

The present invention has been provided to eliminate such defects of the prior art. FIGS. 4, 7–9 show a preferred embodiment of the invention, in which a thread loop regulating element 20 with a predetermined width is fixedly mounted on the underside of a throat plate (not shown) which is secured to the sewing machine. The thread loop regulating element 20 has a downwardly directed end forming a tongue 20*a*. The arrangement is that the thread loop regulating element is in a position vertically spaced from the bobbin carrier 3, and the tongue 20*a* of the regulating element 20 overhangs the place 11 of the bobbin carrier 3 where the thread loop is pulled off the bobbin carrier 3 by the thread take-up lever.

Therefore, according to the present invention, the thread loop 10 as shown in a seam formation process illustrated in FIGS. 9A–9E, is regulated by the tongue 20*a* of the regulating element 20 at the final place 11 of the bobbin carrier 3 where the thread loop 10 is pulled off. Thus, the twisting phenomenon of the upper thread is prevented, and a normal seam is formed through the process of FIG. 9.

We claim:

1. In a sewing machine having a main shaft rotated to vertically reciprocate a needle carrying an upper thread, said needle being swingable transversally of the fabric feeding direction, a throat plate having an upperside and an underside and secured to a machine bed, said throat plate having an aperture formed therein through which the needle traverses to penetrate a fabric to be sewn to thereby produce a thread loop under the throat plate, and loop taking means of horizontal type, a combination comprising a loop taker including a loop taking hook rotated by the main shaft; a bobbin carrier supported in the loop taker and carrying therein a bobbin loaded with a lower thread for forming stitches together with the upper thread, said loop taking hook adapted to take said thread loop to enlarge the same around the bobbin carrier and release the same in the vicinity of the aperture of the throat plate; and thread loop regulating means including a flat plate having a downwardly directed lip formed at one end thereof and extended in the fabric feeding direction, said flat plate being secured to the underside of the throat plate, said bobbin carrier being formed with an upper raised portion, said flat plate and said upper raised portion together with said downwardly directed lip defining a path for guiding the thread loop after the thread loop has been released from the hook of the loop taker, said loop guiding path being so formed as to guide the thread loop, substantially in a direction opposite to the normal fabric feeding direction, said downwardly directed lip providing an end at which the guided thread is released.

* * * * *